US010948153B2

(12) United States Patent
Fischer et al.

(10) Patent No.: US 10,948,153 B2
(45) Date of Patent: Mar. 16, 2021

(54) LIGHTING APPARATUS AND LIGHT MODULE

(71) Applicant: Hella GmbH & Co. KGaA, Lippstadt (DE)

(72) Inventors: Bernd Fischer, Altenbeken (DE); Marc Kaup, Paderborn (DE); Diana Mundt, Lippstadt (DE); Benjamin Willeke, Paderborn (DE); Jan-Henning Willrodt, Hamburg (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/743,671

(22) Filed: Jan. 15, 2020

(65) Prior Publication Data

US 2020/0224849 A1 Jul. 16, 2020

(30) Foreign Application Priority Data

Jan. 15, 2019 (DE) ..... 10 2019 100 904

(51) Int. Cl.
*F21S 43/40* (2018.01)
*F21S 43/20* (2018.01)
*F21S 43/31* (2018.01)

(52) U.S. Cl.
CPC ..... *F21S 43/40* (2018.01); *F21S 43/26* (2018.01); *F21S 43/31* (2018.01)

(58) Field of Classification Search
CPC F21S 43/40; F21S 43/31; F21S 43/26; G08G 1/166; B60Q 9/008; B60Q 1/525; B60Q 2300/45; B60Q 1/2665; B60Q 1/50; B60Q 1/506; B60Q 1/0023; B60Q 2400/50; B60T 2210/32; F21V 7/0008; F21V 7/041
See application file for complete search history.

(56) References Cited

U.S. PATENT DOCUMENTS 9,007,237 B2 * 4/2015 Jafrancesco ..... F21V 7/041 340/985
10,232,713 B2 * 3/2019 Kim ..... B60K 35/00
10,408,411 B2 9/2019 Schwaiger
(Continued)

FOREIGN PATENT DOCUMENTS

DE 102013215374 A1 2/2015
DE 102014226254 A1 6/2016
(Continued)

*Primary Examiner* — Peggy A Neils
(74) *Attorney, Agent, or Firm* — Muncy, Geissler, Olds & Lowe, P.C.

(57) ABSTRACT

A lighting apparatus for an automated or partially automated vehicle, having a light module, which contains a light source unit having a number of light sources and an optical unit assigned to the light source unit for generating a light signal, a surroundings sensor unit for detecting road users in surroundings of the vehicle, a control unit for controlling the light module, so that the light module generates the light signal as a function of the road users detected by the surroundings sensor unit and/or a relative position thereof with respect to the vehicle, the light module being positioned in a defined location of the vehicle and being designed in such a way that the light signal may be radiated at different horizontal and/or vertical spatial angles.

11 Claims, 2 Drawing Sheets

(56) References Cited

U.S. PATENT DOCUMENTS

| | | | | |
|---|---|---|---|---|
| 2008/0175012 | A1 | 7/2008 | Shimaoka et al. | |
| 2016/0195231 | A1 | 7/2016 | Grötsch | |
| 2017/0357004 | A1* | 12/2017 | Puente | F21S 41/14 |
| 2019/0011684 | A1* | 1/2019 | Ishihara | H04N 7/18 |
| 2019/0202341 | A1* | 7/2019 | Rikimaru | F21S 43/26 |
| 2019/0360655 | A1* | 11/2019 | Toko | F21S 41/16 |

FOREIGN PATENT DOCUMENTS

| | | | |
|---|---|---|---|
| DE | 102015207560 | A1 | 10/2016 |
| DE | 202017103902 | U1 | 7/2017 |
| DE | 102016014709 | A1 | 6/2018 |

* cited by examiner

LIGHTING APPARATUS AND LIGHT MODULE

This nonprovisional application claims priority under 35 U.S.C. § 119(a) to German Patent Application No. 10 2019 100 904.9, which was filed in Germany on Jan. 15, 2019, and which is herein incorporated by reference.

BACKGROUND OF THE INVENTION

Field of the Invention

The present invention relates to a lighting apparatus for an automated or partially automated vehicle, which comprises a light module containing a light source unit having a number of light sources and an optical unit assigned to the light source unit for generating a light signal, a surroundings sensor unit for detecting road users in surroundings of the vehicle, a control unit for controlling the light module so that the light module generates the light signal as a function of the road users detected by the surroundings sensor unit and/or a relative position thereof with respect to the vehicle. The invention also relates to a light module for the lighting apparatus.

Description of the Background Art

A lighting apparatus for an automated or partially automated vehicle is known from DE 10 2014 226 254 A1, which comprises multiple light modules, each including a light source unit as well as an optical unit, so that vehicle-related information may be transmitted thereto as a function of road users ascertained with the aid of a surroundings sensor unit in surroundings of the vehicle. For example, a hand gesture may be signaled to the pedestrians, so that the pedestrian knows that the vehicle has detected him and he may, for example, cross the road safely on the crosswalk. A display signaling the hand gesture is disposed, for example, in an area of the vehicle near the rear-view mirror. The known lighting apparatus may include, for example, light sources designed as LEDs, which may be controlled independently of each other and generate an asymmetrical light cone. A surrounding area in an area at a distance of up to 20 meters from the vehicle may be illuminated hereby. However, multiple light modules are necessary to generate light signals of this type in different directions.

A lighting apparatus for an automated and partially automated vehicle is known from DE 10 2016 014 709 A1, which comprises multiple light modules on the vehicle, distributed in the horizontal circumferential direction. A control unit is provided for controlling the light modules so that a corresponding light signal is generated as a function of the present location of the road user in the surroundings of the vehicle or a relative position of the road user with respect to the vehicle. The disadvantage of the known lighting apparatus is that a plurality of light modules must be disposed in a distributed manner on the vehicle for the direction-dependent radiation of the light signals.

SUMMARY OF THE INVENTION

It is therefore an object of the present invention to refine a lighting apparatus and a light module for an automated or partially automated vehicle in such a way that vehicle-related information may be easily emitted in a targeted manner for communicating with other road users in the surroundings of the vehicle.

To achieve this object, in an exemplary embodiment of the invention, the light module can be positioned in a defined location of the vehicle and designed in such a way that the light signal may be radiated at different horizontal and/or vertical spatial angles.

According to an exemplary embodiment of the invention, a light module is provided, which is able to radiate light signals in different directions. A desired light signal may thus be transmitted in a targeted manner to the other road users as a function of the present position determination of another road user. A personalized and directed light signal communication thus takes place. The lighting complexity in the vehicle may be advantageously reduced hereby. It is sufficient to dispose only a single light module to send light signals to different road users positioned in front of and/or next to and/or behind the vehicle. The light module may be disposed, for example, on an A, B, C or D pillar or in a roof area of the vehicle.

The light module can have a plurality of light channels, along which the light is conducted and at whose light outputs the light is radiated in different spatial angle ranges.

A certain light signal may be advantageously radiated in a certain spatial angle range by activating or deactivating the light channels.

An optical unit of the light module can include a lens cone and a reflection cone disposed at a distance therefrom, which are arranged in relation to each other in such a way that parallelized light entering the lens cone is deflected by the reflection cone transversely to the direction of the parallelized light. Light channels may be advantageously formed hereby, at whose outputs light is radiated at a 180° or 360° angle.

The lens cone and the reflection cone can be disposed coaxially to each other, a common axis of an intersecting, parallelized light beam entering the lens cone striking a circumferential ring of the reflection cone, so that light radiates in a circumferential angle of 360°. A light beam entering the lens cone in an eccentric and parallelizing manner is deflected thereby only onto a partial circumferential ring of the reflection cone, so that it is radiated in a circumferential angle of 180°. Light signals may be advantageously radiated hereby at 360° or 180° angles, the position of the circumferential aperture angle of 180° preferably being dependent on the location of the axis of the entering parallelizing light or light beam relative to a center axis of the lens cone. If the parallelized light beam entering the lens cone is controlled in such a way that it enters in an equal radius to the lens cone but at a different circumferential angle, the 180° light emission rotates around the axis accordingly.

The optical unit of the light module can include a diaphragm device with individually activatable diaphragm elements, so that different light channels may be activated or deactivated as a function of the activation or non-activation state of the particular diaphragm elements. Light channels may be advantageously addressed hereby, whose light signals may be emitted in different colors and/or spatial angle ranges. In this way, the light signals may be easily transmitted to the additional road users as a function of the present operating state of the vehicle and/or the relative position.

The diaphragm device can be designed as an LC diaphragm device or an LCOS diaphragm device whose diaphragm elements do not have to be moved mechanically. As a result, the diaphragm device advantageously has a long-term stability.

The diaphragm device may be designed as an apertured disk having a single aperture. If a laser is provided as the light source unit, it may be switched on periodically at corresponding points in time at which the aperture releases a desired light channel.

The light module according to the invention advantageously permits the emission of light signals in different spatial angle ranges, which are a maximum of 360°. In this way, different light signals may be emitted by a single light module in different directions from the vehicle.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
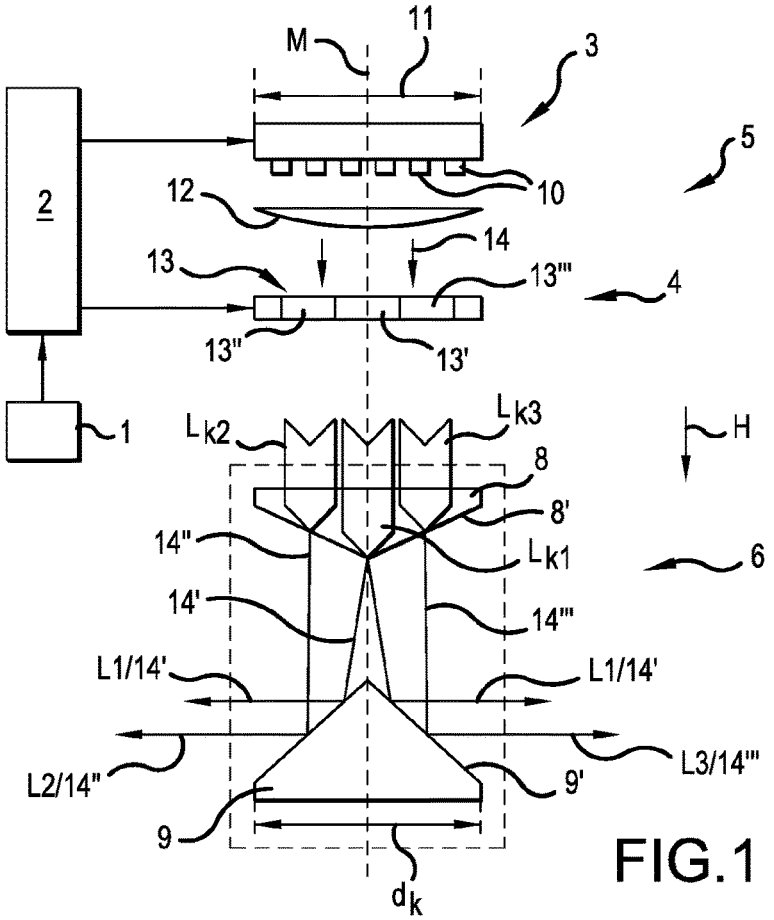
FIG. 1 shows a schematic representation of a lighting apparatus, which comprises an optical unit.

A lighting apparatus according to the invention is designed for automated or partially automated vehicles, so that a communication may take place between the vehicle and at least one additional road user. The lighting apparatus permits the targeted transmission of vehicle-related information to the road user via light signals. The road user is in surroundings of the vehicle, which is detected with the aid of a surroundings sensor unit 1. Surroundings sensor unit 1 may include surroundings sensors such as radar, lidar, an infrared camera, a laser scanner or a stored card material. Surroundings sensor unit 1 feeds a control unit 2 of the lighting apparatus, with the aid of which a light source unit 3 and/or a diaphragm device 4 of the lighting apparatus may be controlled. The lighting apparatus is formed by a single light module 5, which includes light source unit 3 as well as an optical unit 6 having diaphragm device 4. According to the exemplary embodiment described below, optical unit 6 includes, in addition to diaphragm device 4, a light deflecting device 7, which is essentially formed by a lens cone 8 and a reflection cone 9.

As is apparent from FIG. 1, light source unit 3 includes a plurality of light sources 10, which are disposed in a row. According to an alternative specific embodiment of the invention, light sources 10 may also be disposed in a matrix configuration in rows and columns. Light sources 10 may be designed, for example, as LED light sources. For example, light sources 10 emitting red light and light sources 10 emitting green might may be disposed alternately in the row direction of light sources 10. If light sources 10 are arranged in a matrix configuration, light sources emitting red and green light may be disposed in an equal, distributed manner, so that adjacent light sources 10 emit a different color of light. Light source unit 3 thus permits the emission of light 14 along a light width 11, either a single row or, in a matrix formation, multiple rows of light sources 10 being disposed in the direction of light width 11.

A primary optical instrument 12 is assigned to light sources 10 in such a way that light radiated by light sources 10 is parallelized.

Diaphragm device 4, which is preferably designed as a liquid crystal device, is disposed downstream in the luminous flux from primary optical instrument 12 or light source unit 3. Liquid crystal device 4 includes a plurality of diaphragm elements 13 designed as liquid crystal elements, which are also arranged in rows and in parallel to the row of light sources 10. For example, the number of diaphragm elements 13 may correspond to the number of light sources 10. The length of diaphragm device 4 may match length 11 of light source unit 3. Primary optical instrument 12 is used as a light conductor for parallelizing light 14 in optical unit 6.

Particular diaphragm element 13 may allow light 14 to pass or not, depending on a voltage applied to particular diaphragm element 13. For example, if a diaphragm element 13 is activated, it allows light 14 to pass. If diaphragm element 13 is deactivated, it does not allow light 14 to pass. Diaphragm elements 13 thus each define one light channel $LK_n$, at whose light outputs light 14 is radiated in predefined spatial angle ranges and/or predefined light colors. Light signal $L_n$ generated at the light sources in each case occurs as a function of the position of the other road user detected by surroundings sensor unit 1. Light signal $L_n$ is emitted in the direction of the other road user, a red light signal $L_n$ being able to represent the fact that the other road user was detected, and the other road user must yield the right of way to the automated vehicle. If a green light signal $L_n$ is sent to the road user, this may mean that the automated vehicle will stop and yield the right of way to the other road user. This is a directed light signal $L_n$, since light signal $L_n$ is radiated only in a certain spatial angle range, in which the other road user is situated.

Diaphragm device 4 may also be designed as a liquid crystal on silicon (LCOS) diaphragm device or as a digital micromirror device (DMD) instead of as a liquid crystal (LC) diaphragm device.

Reflection cone 9 is disposed upstream from lens cone 8 in main radiation direction H of light source unit 3. Lens cone 8 and reflection cone 9 are disposed coaxially to each other. Lens cone 8 has a cone surface 8' tapering in main radiation direction H on a side facing away from light source unit 3. Reflection cone 9 has a tapered cone surface 9' on a side facing light source unit 3. Tips of cone surface 8' of lens cone 8 and cone surface 9' of reflection cone 9 run on a common axis $A_K$. Axis $A_K$ runs perpendicularly to light source unit 3 disposed in a row (linearly, in a straight line) and diaphragm device 4 disposed in a row (linearly, in a straight line). A diameter $d_K$ of lens cone 8 and reflection cone 9 corresponds to light width 11 of light source unit 3. In the present exemplary embodiment, axis $A_K$ runs in the vertical direction.

To generate a first light signal L1, a first diaphragm element 13' is controlled or activated with the aid of control unit 2, so that diaphragm element 13' is in the pass-through position. The other diaphragm elements 13 are in a deactivated state or in a non-pass-through position. In addition, light source unit 3 may be controlled in such a way that only a specific light source 10 of a predefined color is activated. Due to the fact that middle first diaphragm element 13' has been activated, a first light channel LK1 is formed, according to which a first light beam 14' strikes lens cone 8 on axis $A_K$ and/or in an area near axis $A_K$. First light beam 14' is refracted on cone surface 8' in such a way that it strikes a circumferential ring 15 of cone surface 9' of reflection cone 9, first light beam 14' being radiated as light signal L1 at a circumferential angle of 360° around axis $A_K$ transversely to the direction of parallelized light 14 or transversely to axis $A_K$. Circumferential ring 15 extends at an angle φ1 of 360° around axis $A_K$.

To generate a second light signal L2, only one additional eccentric diaphragm element 13" is activated, while the other diaphragm elements 13 are deactivated. A second light channel L2 is formed hereby, in which a second light beam 14" strikes lens cone 8, offset from first light beam 14'. In contrast to first light beam 14', second light beam 14" now strikes lens cone 8 eccentrically. Due to cone surfaces 8' of lens cone 8, second light beam 14" is refracted only on a first partial circumferential ring 16 of reflection cone 9, so that second light signal L2 is deflected in a spatial angle range of 180° to the side or transversely to a vertical center plane M of light source unit 3 or diaphragm device 4 (lighting apparatus). Second light signal L2 is thus emitted at a partial circumferential angle φ2 of 180°.

Figure 2:
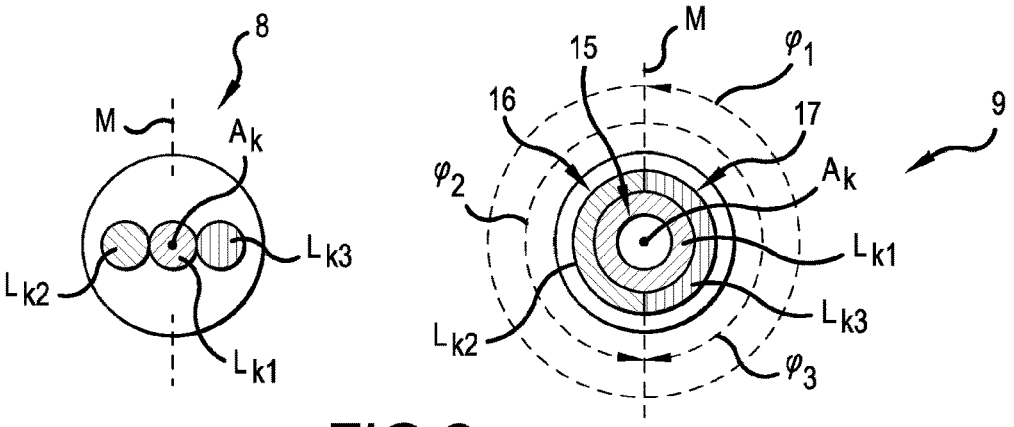
FIG. 2 shows a light input-side top view of a lens cone and a reflection cone of the optical unit according to FIG. 1.

If only one third diaphragm element 13'" is activated in a third state of the lighting apparatus to generate a third light signal L3, while the other diaphragm elements 13 are deactivated, a third light channel LK3 is formed, in which a third light beam 14" strikes the side of cone surface 8' of lens cone 8 opposite second light channel LK2. Third light beam 14" is deflected in such a way that it strikes a side of cone surface 9' of reflection cone 9 opposite second light bundle 14" with respect to vertical center plane M and is reflected thereby laterally toward a side opposite second light beam 14" to form third light signal L3. As is apparent from FIG. 2, third light beam 14'" strikes a second partial circumferential ring 17, which extends along a partial circumferential angle φ3. Second partial circumferential ring 17 is disposed on an opposite side from first partial circumferential ring 16 with respect to vertical center plane M. Third light signal L3 is thus emitted at a partial circumferential angle φ3 of 180°.

Depending on the control of diaphragm device 4, three light channels LK1, LK2, LK3 having different light signals L1, L2, L3 may be activated, light signals L1, L2, L3 being radiated laterally, i.e. transversely to axis $A_K$, according to angle φ1, φ2 or φ3. If axis $A_K$ runs in the vertical direction, light signals L1, L2, L3 are thus radiated essentially in the horizontal direction, circumferential angles φ1, φ2, φ3 essentially extending in the horizontal direction.

Figure 3:
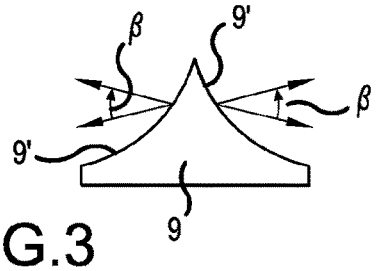
FIG. 3 shows a side view of an reflection cone having a curved reflection surface.

To induce a widening in the vertical direction as well, cone surface 9' of reflection cone 9 according to FIG. 3 may also have a curved design and be designed to be curved inwardly. In this way, a widening of light beam 14 is induced in the direction of axis $A_K$ or in the vertical direction, according to angle ß.

The lens cone 8 may also be omitted if only first light signal L1 is to be radiated at a spatial angle of 360°.

Figure 4:
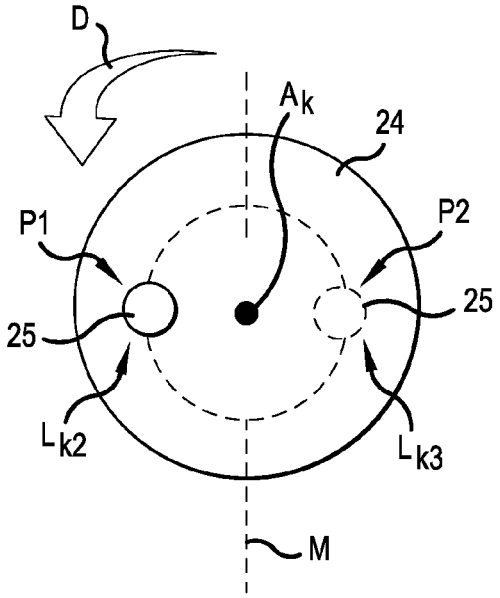
FIG. 4 shows a top view of a diaphragm device of the lighting apparatus, designed as an apertured disk, in a rotational position of an aperture.

According to an alternative specific embodiment of the lighting apparatus according to FIG. 4, diaphragm device 4 may also be designed as an apertured disk 24 having a single aperture 25, which rotates in rotational direction D, preferably at a constant rotational speed. To generate light channels $L_K$, light sources 10 in this specific embodiment are switched on and off with the aid of control unit 2, this taking place periodically as a function of the rotational speed of apertured disk 24. For example, to generate second light channel LK2, corresponding light source 10 is switched on while aperture 25 is in position P1. In this position P1, second light beam 14" is allowed to pass through aperture 25 of apertured disk 24, so that it strikes the light deflecting device illustrated in FIG. 1, made up of lens cone 8 and reflection cone 9, forming second light channel LK2. Second light signal L2 may thus take place by radiation according to angle φ2.

If third light signal L3 is to be generated, light source unit 3 is controlled in such a way that it is activated only when aperture 25 is positioned in position P2. Since, in this position P2, aperture 25 is opposite position P1 with respect to axis $A_K$, third light channel LK3 is now released, so that third light beam 14'" may be radiated on a side opposite vertical center plane M according to spatial angle φ3.

Alternatively, for example, different light sources 10 of light source unit 3 may be activated when aperture 25 is in position P1 and in position P2. In this way, two light signals L2, L3 may be generated simultaneously, which are radiated in different spatial angle ranges φ2, φ3. For example, light sources 10 of different light colors may be controlled so that a red light signal $L_n$ is radiated on one side, and a green light signal $L_n$ is radiated on the other side.

In another state, one or multiple light sources of light source unit 3 may also be switched on continuously, so that the light thereof is allowed to pass through aperture 25 independently of the position thereof. In this way, a 360° radiation according to light signal L1 is possible at angle φ1.

It is assumed that the center axis of apertured disk 24 coincides with axis $A_K$ of the light deflecting device. An imaginary connecting line between position P1 and position P3 of aperture 24 runs in parallel to row 10 of light sources 10 of light source device 3.

Figure 5:
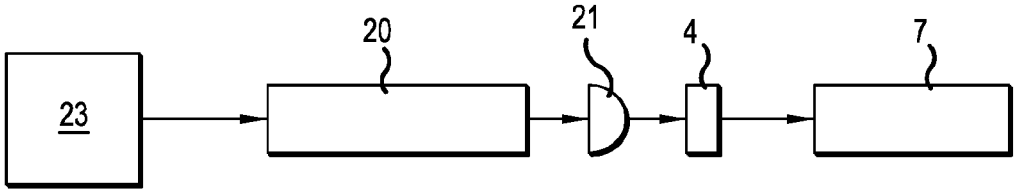
FIG. 5 shows a lighting apparatus of the invention, which comprises a light source unit designed as a laser diode.

According to another specific embodiment of the invention according to FIG. 5, light source unit 3 may be formed by a laser diode 23 whose light is coupled into an optical fiber cable 20. A collimator 21 for parallelizing the light is disposed downstream from optical fiber cable 20 in the luminous flux. Diaphragm device 4 is situated downstream from collimator 21 in the luminous flux. Light deflecting device 7, which is preferably made up of lens cone 8 and reflection cone 9, is situated downstream from diaphragm device 4 in the luminous flux. If laser diode 23 is operated in a pulsed manner, different light signals $L_n$, for example red and green light signals, may be generated simultaneously at different spatial angles. If the laser diode is not operated in a pulsed manner, only one single light signal $L_n$ may be generated.

The diaphragm device 4 may also be disposed downstream from lens cone 8 in the luminous flux and upstream from reflection cone 9 in the luminous flux.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lighting apparatus for an automated or partially automated vehicle, the lighting apparatus comprising:

a light module that has a light source unit having at least one light source and an optical unit assigned to the light source unit to generate a light signal;

a surroundings sensor unit to detect road users in a surrounding of the vehicle; and a control unit to control the light module so that the light module generates the light signal as a function of road users detected by the surroundings sensor unit and/or a relative position thereof with respect to the vehicle, wherein the light module is positioned in a defined location of the vehicle and is designed such that the light signal is adapted to be radiated at different horizontal and/or vertical spatial angles, wherein the optical unit includes a light conductor for parallelizing the light and a light deflecting device for deflecting the light, and wherein the light deflecting device of the optical unit includes a lens cone and a reflection cone disposed downstream therefrom in the luminous flux, which are arranged in relation to each other in such a way that a parallel light beam entering the lens cone is deflected by the reflection cone transversely to the direction of the parallelized light beam.

2. The lighting apparatus according to claim 1, wherein the light module includes multiple light channels whose light outputs lead in different spatial angle ranges so that, as a function of a position of the road user detected by the surroundings sensor unit, the light signal is conducted through one of the light channels whose light output leads to the road user.

3. The lighting apparatus according to claim 1, wherein the light beam deflected by the reflection cone for forming the light channel is dependent on a distance and/or on a circumferential angle of a parallelized light beam entering the lens cone in relation to an axis of the reflection cone.

4. The lighting apparatus according to claim 1, wherein the lens cone and the reflection cone are disposed in relation to each other along the axis such that a parallelized first light beam entering the lens cone on the axis and/or in an area near the axis strikes a circumferential ring of the reflection cone so that the first light beam is deflected at a circumferential angle of 360° with respect to the axis for forming the first light signal, and wherein a parallelized light bundle not intersecting the axis and entering the lens cone strikes a partial circumferential right of the reflection cone so that the additional light beam is deflected at a partial circumferential angle of 180° with respect to the axis to form the additional light channel.

5. The lighting apparatus according to claim 1, wherein the light deflecting device of the optical unit includes a diaphragm device having individually controllable diaphragm elements, wherein a light channel is assigned to the diaphragm elements so that the corresponding light channel is in an activation or non-activation state as a function of a switching state of the diaphragm element.

6. The lighting apparatus according to claim 5, wherein the diaphragm device is a liquid crystal diaphragm device or is a micromirror device.

7. The lighting apparatus according to claim 1, wherein the light deflecting device of the optical unit includes a diaphragm device and wherein the diaphragm device is an apertured disk having a single aperture being arranged at a distance from a rotation axis of the apertured disk, and wherein the light source unit is adapted to be switched on as a function of a rotational position of the apertured disk.

8. The lighting apparatus according to claim 1, wherein the light source unit includes a plurality of LED light sources arranged in a row or in a matrix configuration, or includes a single laser diode operable in a pulsed or non-pulsed manner.

9. A light module comprising the lighting apparatus according to claim 1.

10. The lighting apparatus according to claim 5, wherein the light source unit, the light conductor, the lens cone, the reflection cone and the diaphragm device are provided on a common axis.

11. The lighting apparatus according to claim 5, wherein the diaphragm device is disposed downstream of the light conductor and upstream of the lens cone.

* * * * *